US008735704B2

(12) United States Patent
Buchner

(10) Patent No.: US 8,735,704 B2
(45) Date of Patent: May 27, 2014

(54) CAJON

(71) Applicant: Roland Meinl Musikinstrumente GmbH & Co. KG, Gutenstetten (DE)

(72) Inventor: Michael Buchner, Kelkheim (DE)

(73) Assignee: Roland Meinl Musikinstrumente GmbH & Co. KG, Gutenstetten (DE)

( * ) Notice: Subject to any disclaimer, the term of this patent is extended or adjusted under 35 U.S.C. 154(b) by 0 days.

(21) Appl. No.: 13/743,848

(22) Filed: Jan. 17, 2013

(65) Prior Publication Data

US 2013/0180382 A1 Jul. 18, 2013

(30) Foreign Application Priority Data

Jan. 17, 2012 (DE) ..... 20 2012 000 371 U

(51) Int. Cl.
*G10D 13/02* (2006.01)

(52) U.S. Cl.
USPC ..... 84/411 R

(58) Field of Classification Search
USPC ..... 84/411 R, 402–410
See application file for complete search history.

(56) References Cited

U.S. PATENT DOCUMENTS 8,115,088 B2 * 2/2012 Herrera ..... 84/411 R

FOREIGN PATENT DOCUMENTS

GB 2334366 A * 8/1999
WO WO 2011054539 A1 * 5/2011

* cited by examiner

*Primary Examiner* — Kimberly Lockett
(74) *Attorney, Agent, or Firm* — Browdy and Neimark, PLLC

(57) ABSTRACT

A cajon includes a box-like base body with a lower side, a front, a rear and two mutually remote lateral side walls and an upper side, as well as a playing surface. The base body is provided at the top on the two lateral side walls with widening bodies, which widen the upper side in the lateral direction. The playing surface is formed by the thus widened upper side of the base body lying horizontally in the playing position.

12 Claims, 6 Drawing Sheets

CAJON

CROSS-REFERENCES TO RELATED APPLICATIONS

This application claims the priority of German Utility Model Application, Serial No. 20 2012 000 371.2, filed Jan. 17, 2012, pursuant to 35 U.S.C. 119(a)-(d), the content of which is incorporated herein by reference in its entirety as if fully set forth herein.

FIELD OF THE INVENTION

The invention relates to a cajon with a box-like base body, which has a lower side, a front, a rear and two mutually remote lateral side walls and an upper side.

BACKGROUND OF THE INVENTION

A cajon is traditionally configured as a cuboid box, on which the user sits for playing. The playing surface is, in this case, formed by the front side.

Such known cajons are increasingly widespread as percussion instruments. Their mode of playing, however, entails the drawback that the playing position seated on the cajon and bent forward to reach the playing surface located relatively far down is uncomfortable in the long term. The sound produced is in need of improvement in that the player sits facing the public but the cajon at best has sound openings on its rear, as the front serves as a playing surface and, in this respect, is continuously made from one piece.

Variants of cajons, which avoid the uncomfortable playing position, are, on the one hand, known as so-called "conga cajons", in which the base body is designed to be significantly higher and widening upwardly in a truncated pyramid shape. A conga cajon of this type is played like a conventional conga and the playing surface is thus located at the top. A conga cajon is, however, no longer a simple percussion instrument that is economical and easy to transport because of its size and its mode of construction.

The so-called "bongo cajon", a small cuboid box, in which the side walls run slightly obliquely inwardly, also exhibits a different type of play. The playing surface is also horizontal here, the bongo cajon being clamped for playing between the opened thighs, which can also be uncomfortable in the long term. Because of its smallness, a bongo cajon of this type is, however, not comparable with a conventional cajon.

SUMMARY OF THE INVENTION

The invention is based on an object of configuring a cajon in such a way that the ergonomic properties with regard to the playing position are greatly improved without relevant losses in the sound properties and still with compact dimensions.

This object is achieved by the features of the invention, according to which the base body at the two lateral side walls is provided with widening bodies, which widen the upper side in the lateral direction. The playing surface is, in this case, formed by the thus widened upper side of the base body lying horizontally in the playing position.

It is possible, owing to the design of the cajon according to the invention, to arrange the instrument in a comfortable manner with the base body between the slightly opened thighs, the widening bodies resting on the upper side of the thighs. The instrument does not thus have to be clamped in a tiring manner between the thighs. At the same time, the playing surface is increased by the widening bodies and preferably lies as a continuous, rectangular cover plate with a wide format in relation to the playing position in front of the body of the player. The playing surface can thus be easily reached and can be comfortably played from above.

A comfortable position is also favoured in that, according to a preferred embodiment, the lower sides of the widening bodies are provided with a resilient, adhesion-promoting support plate, for example made of soft rubber. The cajon then rests particularly stably on the thighs of the player.

Owing to the division of the cajon into a base body and the widening bodies, regions of the instrument are provided, which can ensure an improved sound variability with different sound devices. Thus, at least one of the widening bodies, according to a preferred embodiment, may be provided with a snare device below the playing surface. The player can thus produce different sound effects by beating different regions of the playing surface, in that, for example, the central region of the playing surface can ensure a powerful bass sound, while when beating the playing surface in the region of the widening body with the snare device, the typical "rattling" snare sound is produced.

The differentiation between the individual sound effects can be further reinforced in that the widening body having the snare device is provided on its lower side with a sound opening and/or is sealed off in the interior by a partition wall from the base body interior.

With regard to the sound properties of the actual cajon base body, these can be improved by a bass amplification tube inserted into the front side wall and known per se of cajons. In comparison to conventional cajons, in which such bass amplification tubes can at best be present in the rear side wall, by turning the tubes to the public, the bass sound can be substantially improved there.

Further preferred embodiments of the subject of the invention relate to the dimension ratios of the widening bodies in comparison to the base body, on the basis of which the ergonomic properties of the cajon can be optimised. Thus, the base body is approximately square in design in horizontal section. The height of the widening bodies approximately corresponds to 0.2 times the overall height of the cajon. The width of the widening bodies is approximately 0.4 to 0.5 times the width of the base body.

Further features, details and advantages of the invention emerge from the following description of an embodiment with the aid of the accompanying drawings.

DESCRIPTION OF THE PREFERRED EMBODIMENT

Figure 1:
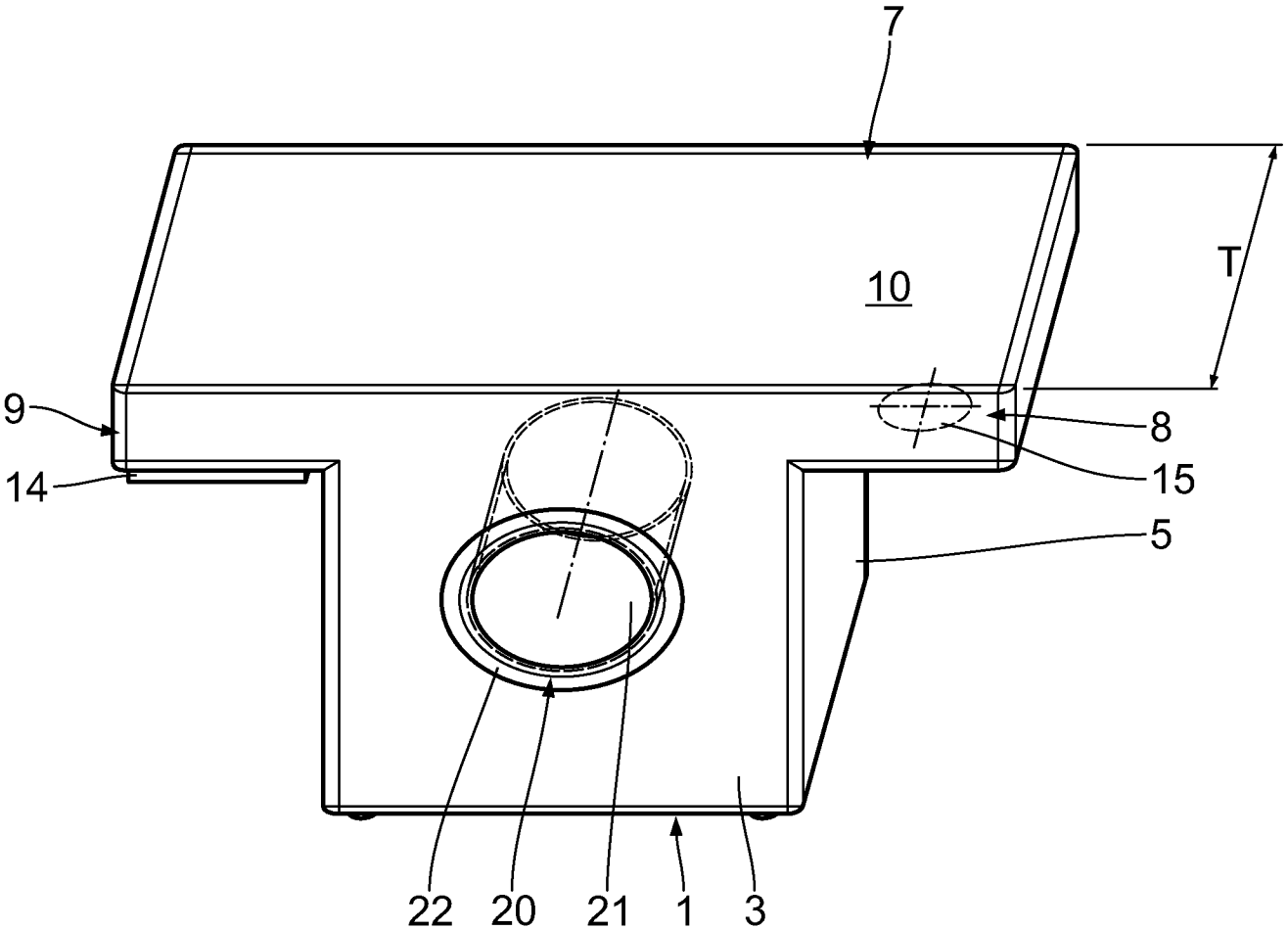
FIGS. 1 and 2 show perspective views from above and below of a cajon.
Figure 2:
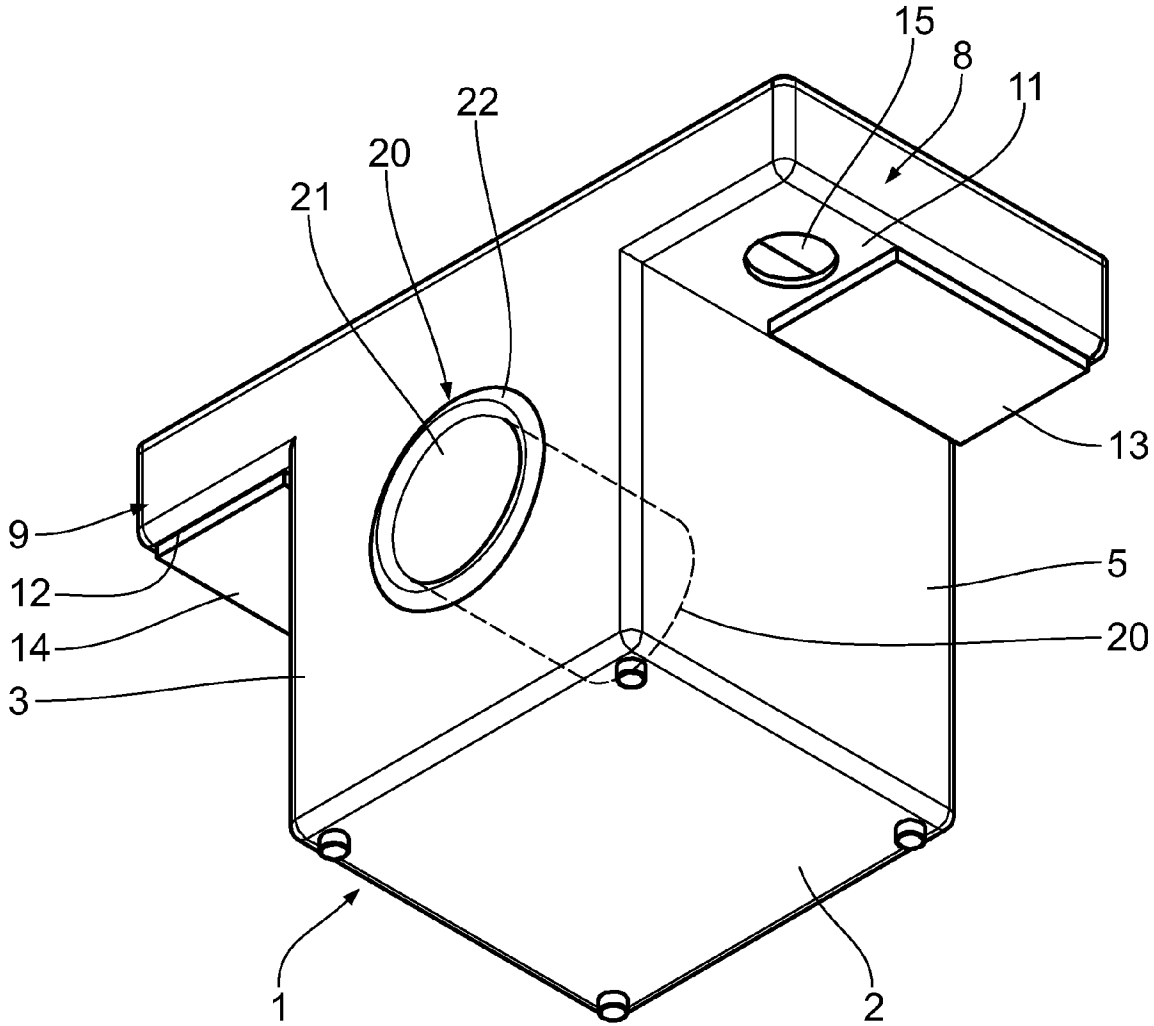
Figure 3:
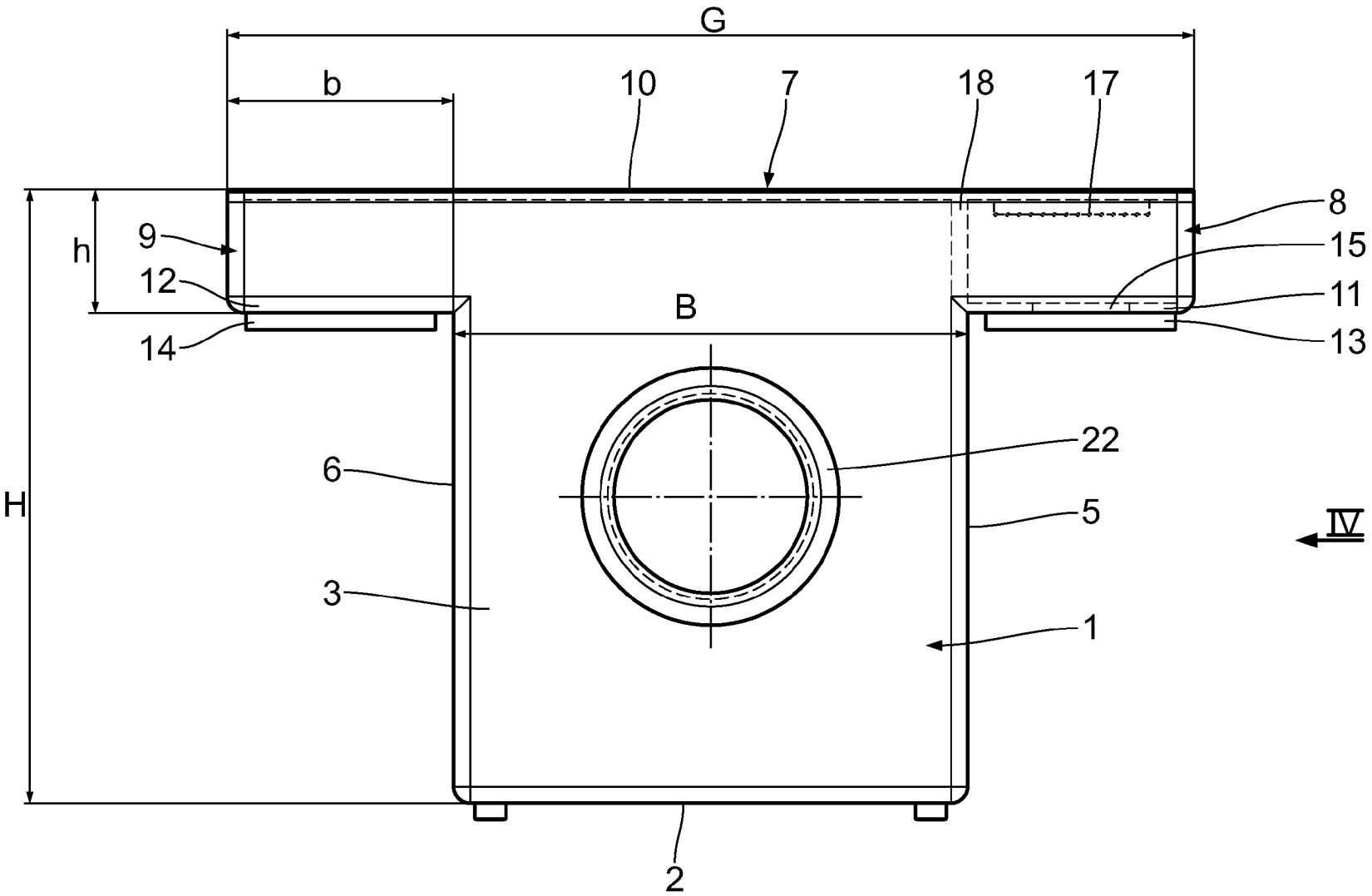
FIG. 3 shows a front view.
Figure 4:
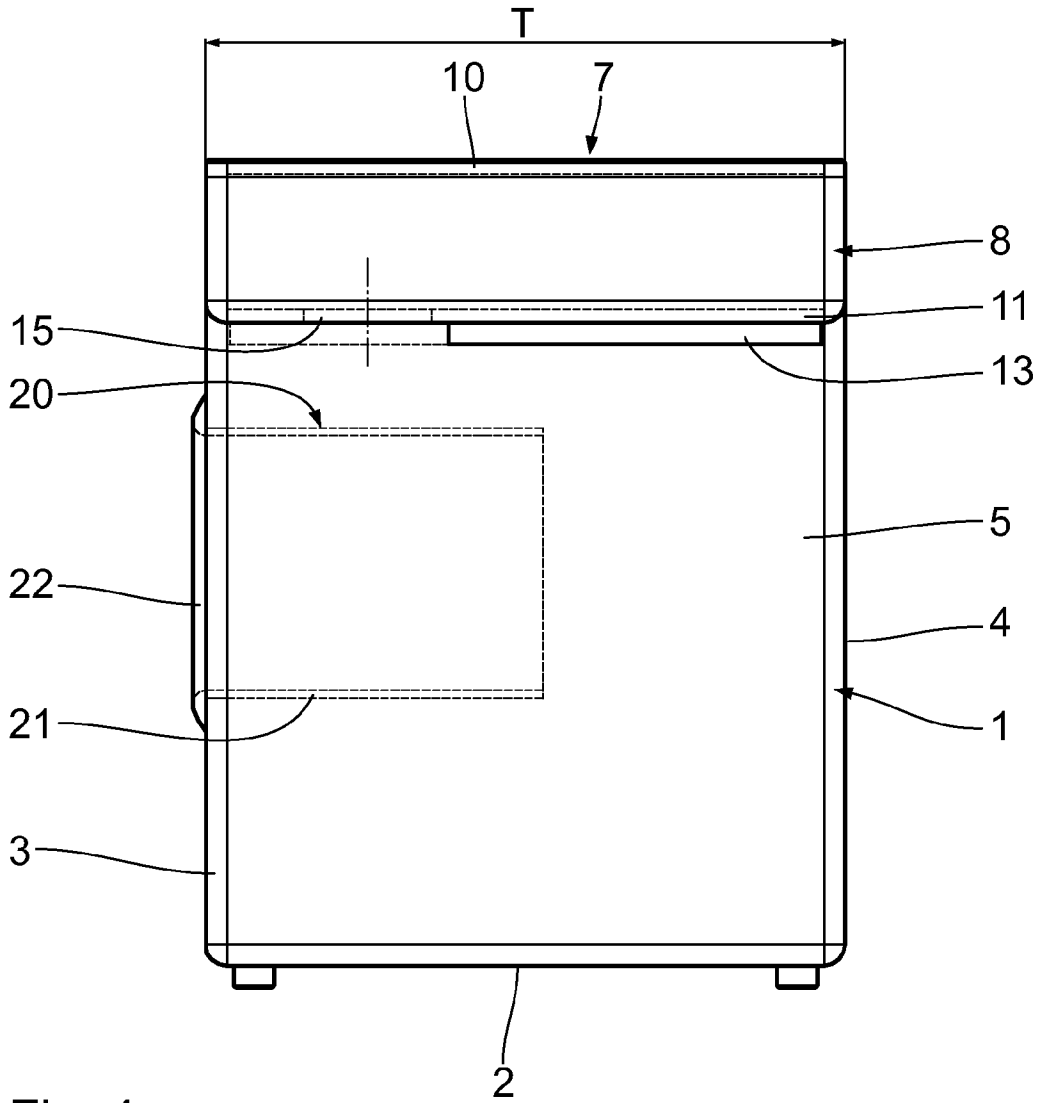
FIG. 4 shows a side view from the arrow direction IV according to FIG. 3.
Figure 5:
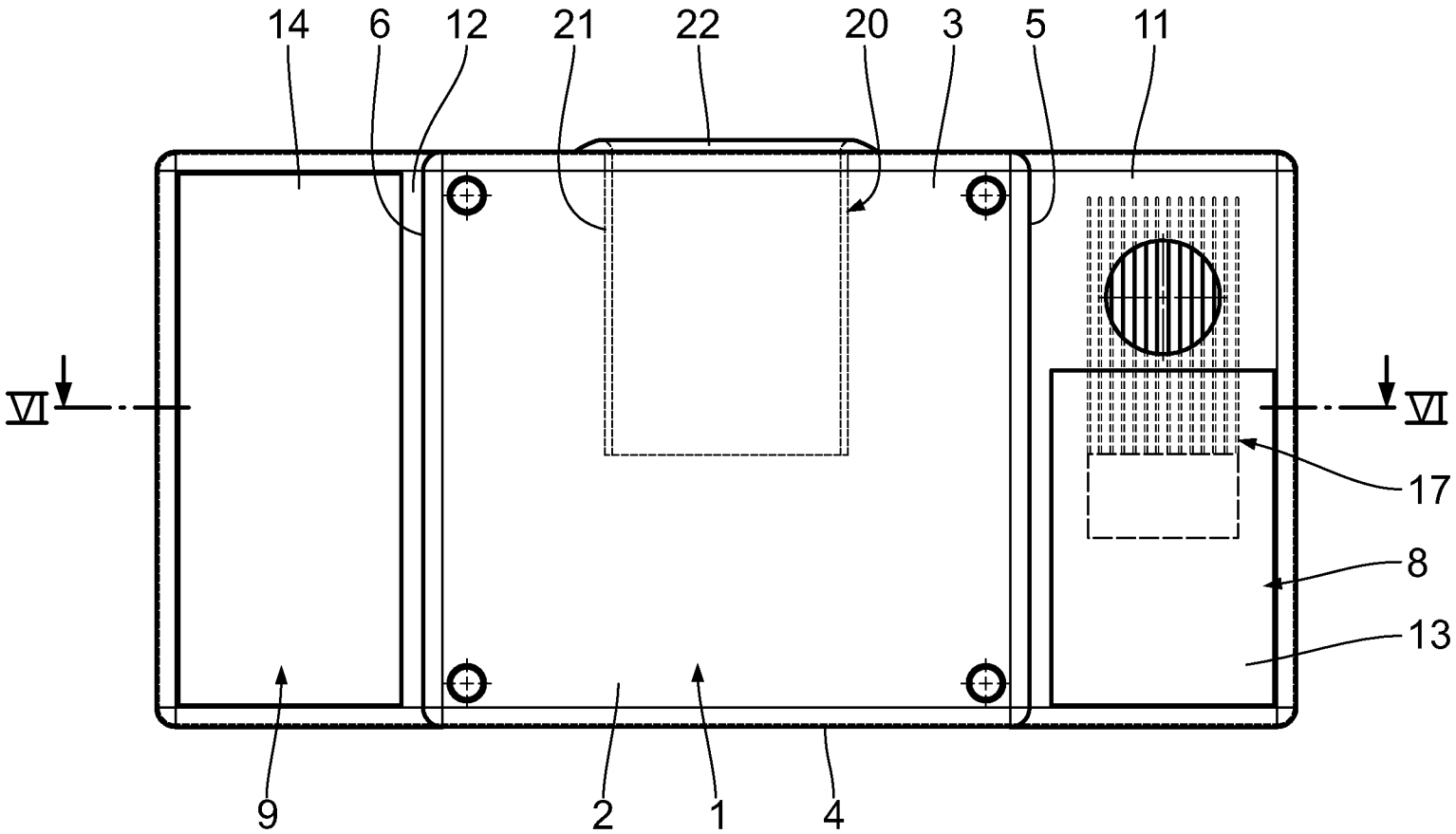
FIG. 5 shows a view from below of the cajon.
Figure 6:
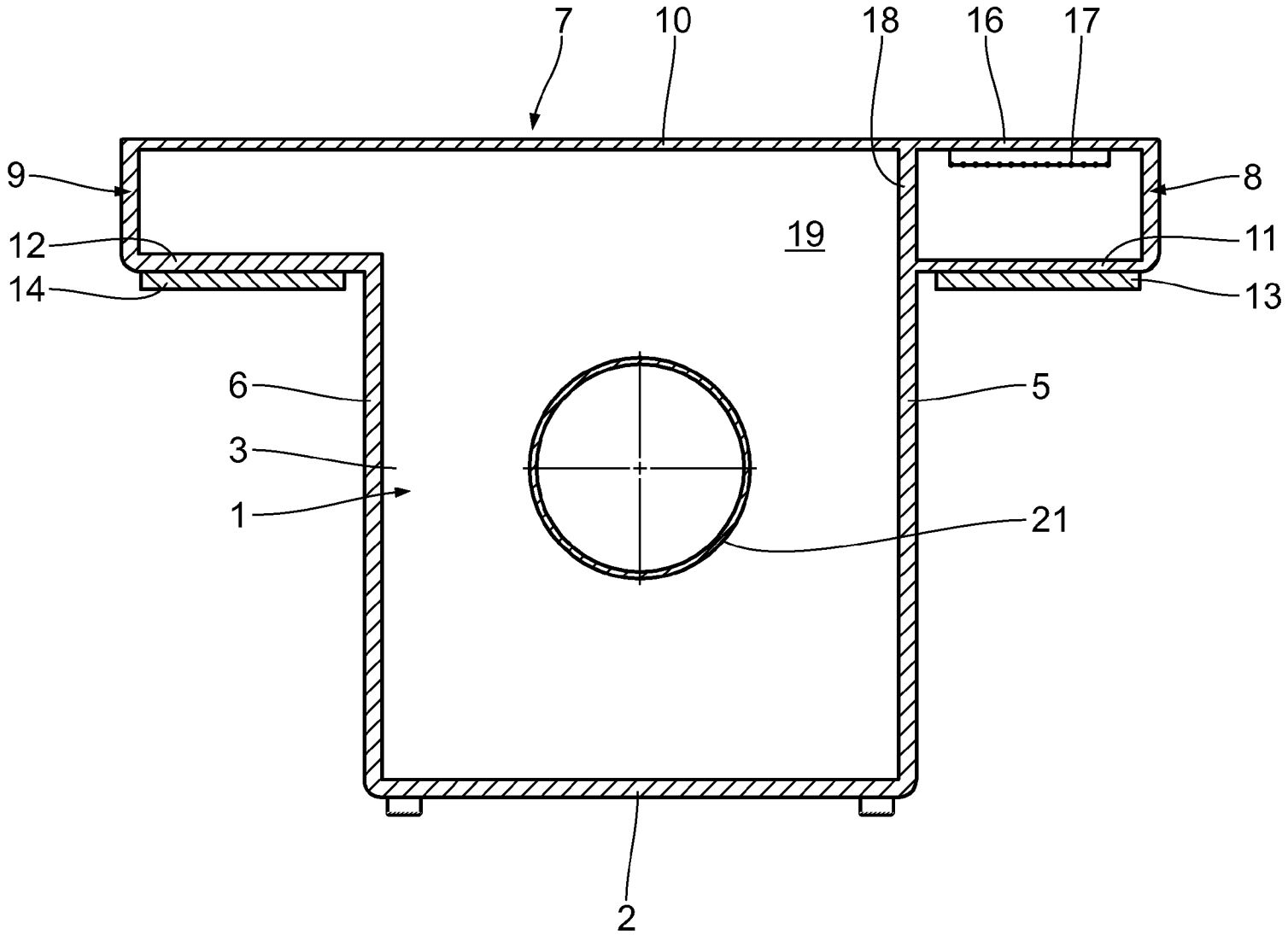
FIG. 6 shows a vertical section along the section line VI-VI according to FIG. 5.

As becomes clear, in particular from FIGS. 1 and 2, the cajon has a box-like base body 1 with a lower side 2, a front side wall 3, a rear side wall 4 concealed in the two drawings, two lateral side walls 5, 6 remote from one another, as well as an upper side designed generally as a whole by 7. The base body 1 is provided at the top on the two lateral side walls 5, 6 with box-like, cuboid widening bodies 8, 9, which widen the upper side 7 in the lateral direction. This thus widened upper side 7 of the base body 1 lying horizontally in the playing position of the cajon then forms the playing surface 10. This is formed by a rectangular cover plate made of a composite laminated wood, which is continuous over the base body 1 and the widening bodies 8, 9. As becomes clear, in particular from FIG. 1, the playing surface is placed with a wide format in relation to the playing position in front of the body of a player, not shown in more detail.

As becomes clear from FIGS. 2 to 6, the lower sides 11, 12 of the widening bodies 8, 9 are provided with a resilient, adhesion-promoting support plate 13, 14, for example made of a foamed rubber material. The left-hand support plate 13, viewed from the player, does not run here—like the right-hand support plate 14—over the entire depth T of the widening body 8, but only approximately over two thirds of the depth. In the front region, which remains free, of the lower side 11, the widening body 8 is provided with a sound opening 15, above which a snare device designated 17 as a whole is attached to the lower side of the cover plate 16 forming the playing surface 10. Said snare device consists—as indicated in particular in FIGS. 3 to 6—of a large number of resilient wires, as is adequately known from cajons from the prior art. To this extent, further statements with regard to the snare device 17 are superfluous.

Moreover, the widening body 8 having the snare device 17 is sealed off in the interior by a partition wall 18 from the interior space 19 of the remaining base body 1. With this measure in combination with the sound opening 15, the sound of the snare device 17 can be particularly intensively perceived when beating the playing surface 10 in the region of the widening body 8.

A further sound improvement measure is a bass amplification tube 20, which is inserted centrally in the front side wall 3 and is formed from a horizontally oriented connecting piece 21 projecting into the interior space 19 and a flange-like annular shoulder 22 placed on the front end thereof. Said annular shoulder is glued to the front side wall 3, so the bass amplification tube 20 is rigidly fixed on the cajon.

With regard to the dimensions, it should be noted that the base body 1 is approximately square in design in horizontal section. Its dimensions are, for example 23 to 24 cm deep and 25 cm wide. The height H of the base body 1 may, for example, be just 30 cm, the height h of the widening bodies 8, 9 being approximately 6 cm. Their width b corresponds approximately to 0.4 to 0.5 times the width B of the base body 1 and is, for example 11 cm. This produces an overall width G of the playing surface 11 of 47 cm.

What is claimed is:

1. A cajon comprising:

a box-like base body with a lower side, a front, a rear and two mutually remote lateral side walls and an upper side, a playing surface, wherein the base body is provided at a top on the two lateral side walls with widening bodies, which widen the upper side in the lateral direction, and wherein the playing surface is formed by the thus widened upper side of the base body lying horizontally in a playing position.

2. A cajon according to claim 1, wherein the playing surface is formed by a rectangular cover plate which is continuous over the base body and the widening bodies.

3. A cajon according to claim 2, wherein the playing surface has a wide-format design in relation to a playing position in front of a body of a player.

4. A cajon according to claim 1, wherein the lower sides of the widening bodies are provided with a resilient, adhesion-promoting support plate.

5. A cajon according to claim 1, wherein at least one of the widening bodies is provided with a snare device below the playing surface.

6. A cajon according to claim 5, wherein the widening body having the snare device is provided with a sound opening on its lower side.

7. A cajon according to claim 5, wherein the widening body having the snare device is sealed off in the interior by a partition wall from the base body interior space.

8. A cajon according to claim 1, wherein a bass amplification tube is inserted in at least one of the side walls.

9. A cajon according to claim 8, wherein the bass amplification tube is inserted in the front side wall.

10. A cajon according to claim 1, wherein the base body is approximately square in design in horizontal section.

11. A cajon according to claim 1, wherein a height of the widening bodies corresponds to about 0.2 times an overall height of the cajon.

12. A cajon according to claim 1, wherein a width of the widening bodies corresponds to 0.4 to 0.5 times a width of the base body.

* * * * *